United States Patent [19]

Sequeira, Jr. et al.

[11] 4,294,689

[45] Oct. 13, 1981

[54] SOLVENT REFINING PROCESS

[75] Inventors: Avilino Sequeira, Jr., Port Arthur; Benjamin F. Smith, Jr., Groves; Theodore C. Mead, Port Neches, all of Tex.

[73] Assignee: Texaco, Inc., White Plains, N.Y.

[21] Appl. No.: 121,571

[22] Filed: Feb. 14, 1980

[51] Int. Cl.[3] ..... C10G 21/20

[52] U.S. Cl. ..... 208/326; 208/322

[58] Field of Search ..... 208/322, 325, 326

[56] References Cited

U.S. PATENT DOCUMENTS

| | | | |
|---|---|---|---|
| 2,128,029 | 8/1938 | Hendrey | 208/335 |
| 3,470,089 | 9/1969 | Morris et al. | 208/326 |
| 4,057,491 | 11/1977 | Bushnell et al. | 208/321 |

*Primary Examiner*—Delbert E. Gantz
*Assistant Examiner*—William Leader
*Attorney, Agent, or Firm*—Cooper, Dunham, Clark, Griffin & Moran

[57] ABSTRACT

An improved process for solvent refining lubricating oil base stocks from petroleum fractions containing both aromatic and non-aromatic constituents utilizing N-methyl-2-pyrrolidone as a selective solvent for aromatic hydrocarbons wherein the refined oil fraction and the extract fraction are freed of final traces of solvent by stripping with gaseous ammonia.

The process has several advantages over conventional processes including a savings in energy required for the solvent refining process, and reduced corrosion of the process equipment.

4 Claims, 1 Drawing Figure

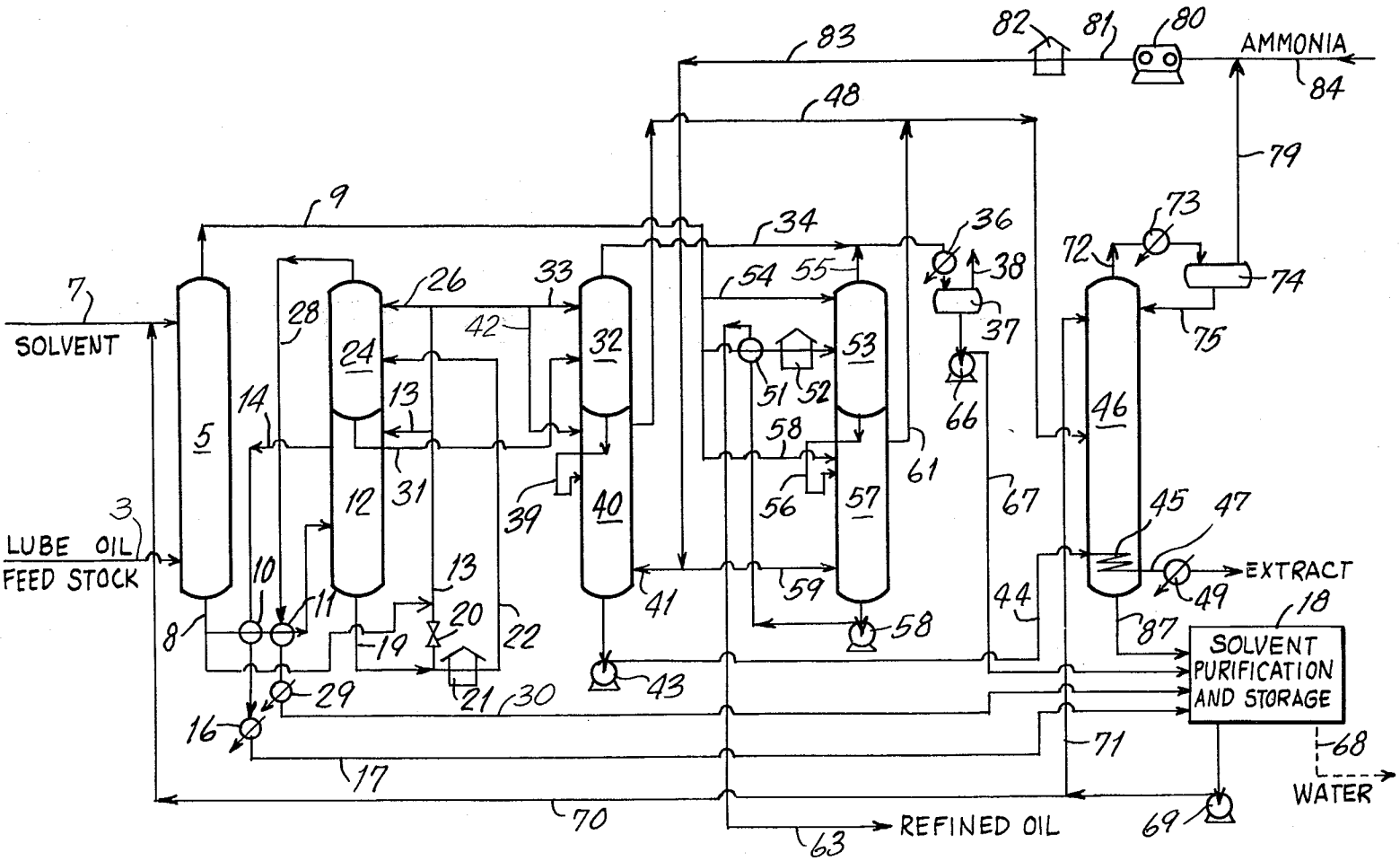
AMMONIA
EXTRACT
SOLVENT PURIFICATION AND STORAGE
WATER
REFINED OIL
SOLVENT
LUBE OIL FEED STOCK

SOLVENT REFINING PROCESS

The invention relates to an improved process for the solvent extraction of a petroleum oil fraction containing aromatic and non-aromatic constituents. In one of its more specific aspects, the invention relates to a method for improving the recovery of solvent from the raffinate and extract products of a solvent refining process. The invention is particularly applicable to solvent refining of lubricating oils with N-methyl-2-pyrrolidone as the selective solvent. A savings in the energy requirements of a solvent refining process, as compared with conventional systems, may be realized by the process of this invention.

It is well known that aromatic and unsaturated constituents of a lubricating oil base stock, such as those derived from crude petroleum by fractional distillation, may be separated from the more saturated hydrocarbon components by various processes involving solvent extraction of the aromatic and unsaturated hydrocarbons. Foremost among the processes which have received wide commercial acceptance are those in which the extraction is carried out with furfural, phenol or N-methyl-2-pyrrolidone as the selective solvent.

The removal of aromatic and other undesirable constituents from lubricating oil base stocks improves the viscosity index, color, oxidative stability, thermal stability, and inhibition response of the base oils and of the ultimate lubricating oil products produced therefrom.

The process of this invention is particularly adaptable to existing N-methyl-2-pyrrolidone solvent refining installations. A number of advantages of N-methyl-2-pyrrolidone as a selective solvent for the removal of aromatic and polar constituents from lubricating oil base stocks is now well recognized by refiners. Further advantages result from the operation of N-methyl-2-pyrrolidone solvent refining units in accordance with the process of this invention.

Processes employing N-methyl-2-pyrrolidone as solvent and illustrating conventional solvent recovery operations are disclosed in U.S. Pat. Nos. 3,461,066 and 3,470,089.

In conventional lubricating oil refining, the solvent extraction step is carried out under conditions effective to recover about 30 to 90 volume percent of the lubricating oil charge as raffinate or refined oil and to extract about 10 to 70 volume percent of the charge as an aromatic extract. The lubricating oil stock is contacted with a solvent, for example, furfural or N-methyl-2-pyrrolidone, at a temperature at least 5° C., preferably at least 50° C., below the temperature of complete miscibility of said lubricating oil stock in said solvent.

A number of solvents are known which have an affinity for at least one component of a mixed base lubricating oil charge stock and which are partially immiscible with the lubricating oil charge stock under conditions in the oil-solvent contacting zone. The two liquid phases in the contacting zone generally consist essentially of an extract phase containing the major amount of the solvent together with minor aromatic components of the charge stock, and a raffinate phase containing non-aromatic components of the charge stock together with minor amounts of solvent.

Particularly preferred solvents are N-methyl-2-pyrrolidone and furfural, both of which are effective for the solvent extraction of aromatic components from lubricating oil charge stocks at relatively lower temperatures and lower solvent oil dosages than most other known solvents. N-methyl-2-pyrrolidone is generally the most preferred solvent because of its chemical stability, low toxicity, and its ability to produce refined oils of improved quality.

In the extraction step, operating conditions are selected to produce a primary raffinate having a viscosity index (VI), after dewaxing, within the range of about 75 to 100, and preferably, about 85 to 96. Operating conditions for solvent extraction of lubricating oil base stocks derived from various petroleum feedstocks are generally well known in the art and are described, for example, in U.S. Pat. Nos. 3,451,925; 3,461,066; 3,470,089 and 3,472,757, incorporated herein by reference. In general when N-methyl-2-pyrrolidone is employed as solvent, solvent extraction temperatures within the range of 43° to 100° C. (110° to 212° F.), preferably within the range of 55° to 95° C. (about 130° to 205° F.), with solvent dosages within the range of 50 to 500 percent, and preferably within the range of 100 to 300 percent, are suitable.

To produce a finished lubricating oil base stock, the primary raffinate is dewaxed to the desired pour point. If desired, the refined or dewaxed oil may be subjected to a finishing treatment for color and stability improvement, for example, mild hydrogenation.

In conventional solvent refining processes, various methods are employed for the separation and recovery of solvent from the extract and for the recovery of solvent-free extract and solvent-free raffinate from the extract and raffinate mixtures formed in the extraction step. The nature of the recovery system usually depends to some extent on the particular solvent employed and whether or not the solvent also contains a moderator, such as water.

In conventional solvent separation and product recovery systems, the final products are usually treated for the removal of the final traces of solvent by contacting the products, i.e., the raffinate and extract, with a suitable stripping medium, for example, steam, methane, nitrogen, or the like.

In accordance with the process of this invention, the final stripping of solvent from the products is carried out with gaseous ammonia, rather than with an inert gas or steam as in the prior art. The advantages of the process of the invention will be evident from the following detailed description of a preferred embodiment of the invention as applied to an otherwise relatively conventional separation system. Details of the invention will be evident from the accompanying figure and the following detailed description.

The figure is a simplified schematic flow diagram illustrating the process of this invention as applied to a commercial solvent refining operation.

With reference to the FIGURE, lubricating oil feedstock is introduced through line 3 to an extraction tower 5 wherein it is intimately countercurrently contacted with solvent entering the upper part of the extraction tower 5 through line 7. In the extraction tower 5, the lubricating oil feedstock is contacted with N-methyl-2-pyrrolidone. The solvent extraction tower 5 typically is operated under a pressure in the range of 0 to 100 psig (about 1 to 8 bar) and preferably in the range of 20 to 50 psig (about 2.4 to about 4.5 bar).

Two liquid phases are present in extraction tower 5, a solvent-rich extract phase containing aromatic constituents of the feedstock and a raffinate phase containing non-aromatic constituents of the feedstock. The extract mixture, typically comprising about 85 percent solvent, is withdrawn from the bottom of extraction tower 5 through line 8. The raffinate mixture, typically comprising 85 percent hydrocarbon oil admixed with solvent, is discharged from the upper end of extraction tower 5 through line 9 and processed for the recovery of raffinate from the solvent as described hereinafter.

The major portion of the solvent appears in the extract mixture withdrawn from the bottom of extraction tower 5 through line 8. Conventionally, the extract mixture is processed first for the recovery of solvent from the extract then further processed for recovery of the extract substantially free from solvent as a marketable product of the process. Accordingly, the resulting extract mixture withdrawn from the bottom of extraction tower 5 through line 8 is passed through heat exchangers 10 and 11, which serve to preheat the extract mixture, and is introduced into the upper part of a low pressure flash tower 12. Low pressure flash tower 12 typically operates at a pressure in the range of 1.7 to 2 bar (10 to 15 psig).

Solvent separated from the extract in tower 12 is discharged through line 14 to heat exchanger 10 wherein it is cooled by indirect heat exchange with the extract mixture from extraction tower 5 thereby preheating the extract mixture prior to introduction to tower 12 and condensing solvent vapors. The solvent is further cooled and condensed in a cooler 16 and passed through line 17 to solvent storage and purification system 18 for reuse in the process.

The unvaporized portion of the extract is withdrawn from the bottom of low pressure flash tower 12 through line 19. In a preferred embodiment of this invention, part of the extract fraction from extraction tower 5 is supplied to the upper part of tower 12 as reflux via line 13. The extract fraction from tower 12 is passed through heater 21 and introduced via line 22 to a high pressure flash tower 24. The high pressure flash tower 24 suitably is maintained at a pressure within the range of 3.75 to 4.1 bar (40 to 45 psig) and is provided with a reflux extract fraction from tower 5, or optionally from tower 12 (via line 20) which enters the upper part of tower 24 through line 26.

A further amount of solvent is separated from the extract in high pressure flash tower 24. Solvent vapors withdrawn from the top of the tower 24 through line 28 are passed through heat exchanger 11 for indirect heat exchange with extract mixture from extraction tower 5, serving to condense the solvent vapors and further preheat the extract prior to its introduction to flash tower 12. Following the heat exchange, the solvent condensate is further cooled in a cooler 29 and the condensed solvent passed through line 30 to solvent purification and storage 18 for reuse in the process.

The extract mixture, still containing some solvent, for example, a mixture of 85 volume percent hydrocarbon oil and 15 volume percent solvent, is withdrawn from the lower portion of high pressure flash tower 24 through line 31 to vacuum flash tower 32.

Vacuum flash tower 32 typically is a countercurrent vapor-liquid contact column, suitably a cascade or bubble tray type column. Part of the extract mixture from extraction tower 5 or low pressure flash tower 12 is introduced near the top of tower 32 through line 33 as reflux. Vacuum flash tower 32 typically operates at a pressure in the range of 0.01 to 0.9 bar (0.15 to 13 psia).

In the vacuum flash tower 32, additional separation of extract from solvent takes place. Solvent vapors are withdrawn from the upper portion of flash tower 32 through line 34 to a condenser 36 wherein the solvent vapors are condensed and the condensate solvent collected in condensate accumulator 37. Uncondensed gases are withdrawn from the accumulator 37 through line 38 to a vacuum system, not illustrated.

An extract-rich fraction is withdrawn from the lower part of vacuum flash tower 32 through line 39 and introduced into the upper portion of stripper 40. Stripper 40 is typically a countercurrent vapor-liquid contact column provided with cascade or bubble trays in which the liquid extract flowing downwardly through the column is contacted with ammonia introduced into the lower part of stripper 40 through line 41. In the process of this invention, stripper 40 may be operated at a temperature within the range of 150° to 315° C. (about 300° to 600° F.) and a pressure within the range of 0 to 5 bar (0 to 60 psia), preferably 1 to 3 bar (0–30 psig). A further portion of the extract from extraction tower 12 is supplied to the upper part of stripper 40 through line 42 as reflux. Extract oil containing less than about 50 ppm solvent is withdrawn from the lower part of stripper 40 by pump 43 and passed through line 44 to a reboiler 45 in solvent recovery tower 46, described hereinafter, and discharged through line 47 and cooler 49 as a product of the process.

In the process of this invention, gaseous ammonia is introduced into the lower part of stripper 40 through line 41. Solvent vapors mixed with ammonia are discharged from the upper part of stripper 40 through line 48 to a solvent recovery tower 46 wherein the solvent is separated from the ammonia as described in more detail hereinafter.

The raffinate mixture leaving the top of the extraction column 5 through line 9 is passed through heat exchanger 51 and heater 52 wherein the raffinate mixture is heated and then introduced into a vacuum flash tower 53 similar to vacuum flash tower 32, previously described. A portion of the unheated raffinate mixture from line 9 is supplied through line 54 to the upper portion of the flash tower 53 as reflux. Solvent vapors are taken overhead from flash tower 53 to condenser 36 via lines 55 and 34, together with solvent vapors from flash tower 32, for recovery of solvent.

The unvaporized portion of the raffinate mixture is withdrawn from the bottom of vacuum flash tower 53 through line 56 into the upper portion of a stripping column 57 which is similar to stripping column 40, previously described. A part of the unheated raffinate mixture from line 9 is supplied to the upper part of stripping column 57 through line 58 as reflux. Gaseous ammonia is introduced into the lower part of stripper 57 through line 59 as the stripping medium. Stripper 57 may be operated at a temperature within the range of 150° to 315° C. (about 300° to 600° F.) and a pressure within the range of 1 to 3 bar (0 to 30 psig).

Ammonia and solvent vapors are discharged from stripper 57 through line 61 into line 48 and passed together with ammonia and solvent from stripper 40 to recovery tower 46 wherein the solvent is separated from the ammonia. The bottoms product from stripper 57, substantially completely freed from solvent, is passed by pump 58 through cooler 51 and discharged through line 63 as solvent refined lubricating oil base stock, the principal product of the process.

Condensate from condensate accumulator drum 37 is passed by pump 66 to solvent purification and storage 18 via line 67 for reuse in the process.

It is to be understood that various process steps may be utilized in the purification of solvent for reuse in the process as necessary, including, for example, distillation, azeotropic separation, gas stripping, and the like primarily for the removal of water, if present, light oils, polymers, and the like. In the simplified flow diagram of the figure, solvent purification steps are not illustrated as they are relatively unnecessary in the process of the present invention provided that care is exercised in eliminating water from the lubricating oil feedstock entering the system, particularly when N-methyl-2-pyrrolidone is employed as the selective solvent in the process. Water which may find its way into the system by way of the oil feed stock or from extraneous sources may be separated from the solvent in known manner and discharged from the system through line 68. Solvent from purification and storage 18 is returned to the process by pump 69, part of the solvent passing through line 70 into the upper part of extraction tower 5 through line 7 and a further portion passing through line 71 to the upper part of solvent recovery tower 46.

Ammonia stripping gas is recovered from the vapor stream leaving strippers 40 and 57 through lines 48 and 61 by condensation of the solvent and separation of the condensate solvent from gaseous ammonia in solvent recovery tower 46. Solvent recovery tower 46 is a countercurrent vapor-liquid contact device, suitably a packed tower, or a cascade or bubble tray type tower in which the mixture of ammonia and solvent vapors from line 48 suitably at a temperature in the range of 120° to 180° C. are introduced at a midpoint in the tower and liquid solvent from solvent purification and storage system 18 suitably at a temperature in the range of 40° to 70° C. is introduced at the upper part of the tower as reflux. The solvent recovery tower is suitably operated at a pressure in the range of 0 to 5 bar (0 to 60 psia), preferably 1 to 3 bar (atmospheric pressure to about 30 psig), a top temperature in the range of 50° to 95° C. (about 120° to about 200° F.) and a bottom temperature in the range of 150° to 175° C. In the solvent recovery tower 46, ammonia is substantially completely separated from solvent and discharged from the upper part of tower 46 through line 72 to condenser 73 where any solvent carried over from the solvent recovery tower is condensed and separated from the gaseous ammonia in separator 74. Solvent separated from the gaseous ammonia in separator 74 is returned to tower 46 through line 75.

Solvent is withdrawn from the bottom of solvent recovery tower 46 through line 87 to solvent purification and storage system 18.

Gaseous ammonia, substantially free from solvent and water vapor, is discharged from the upper part of separator 74 at a temperature in the range of from about 35° to about 90° C. through line 79 to compressor 80 and passed through line 81 to heater 82 where it is heated to an elevated temperature, suitably in the range of 150° to 315° C. (about 300° to 600° F.), and passed through line 83 and lines 41 and 59 to strippers 40 and 57, respectively.

Some ammonia is lost in the process through reaction with acid components in the hydrocarbon feedstock. Makeup ammonia from a suitable source is supplied to the system through line 84.

In the process of this invention, the ammonia serves the dual purpose of acting as an effective desorbing medium for stripping residual solvent from the product extract and product raffinate in strippers 40 and 57 and as a corrosion inhibitor throughout the entire system. The use of ammonia as stripping medium substantially eliminates dilution of solvent with water as well as reducing or eliminating corrosion problems which are common in systems employing steam as a stripping agent. Additionally, the energy requirements for the purification of solvent in the process of this invention, as compared with processes employing steam as the stripping medium, are substantially reduced.

We claim:

1. In a process for solvent refining a lubricating oil feedstock wherein said lubricating oil feedstock is contacted with N-methyl-2-pyrrolidone as selective solvent for aromatic constituents of said feedback in an extraction zone thereby forming an extract phase rich in said aromatic constituents and comprising a major portion of said solvent and a non-aromatic raffinate phase comprising a minor portion of said solvent, said raffinate phase is separated from said extract phase, and solvent is removed from each of said phases by flash vaporization, distillation, rectification, or a combination thereof, the improvement which comprises stripping residual solvent from said extract and from said raffinate with gaseous ammonia thereby forming a mixture of gaseous ammonia and solvent vapor, passing said mixture of gaseous ammonia and solvent vapor to a solvent recovery zone wherein said mixture is cooled to a temperature sufficient to condense at least a portion of said solvent therefrom, separating gaseous ammonia from liquid condensate solvent, returning said condensate solvent to said extraction zone, and passing gaseous ammonia from which solvent has been removed into contact with said extract and said raffinate as said stripping gas for the removal of solvent therefrom.

2. A process according to claim 1 wherein said mixture of ammonia and solvent vapors is cooled to a temperature effecting condensation of the major portion of said solvent vapors to liquid solvent condensate containing a minor portion of dissolved ammonia, and said condensate liquid solvent containing a minor amount of ammonia is supplied to said extraction zone as a part of the solvent therefor.

3. A process according to claim 1 wherein said mixture of ammonia and solvent vapors is cooled to a temperature in the range of from about 35° to about 95° C. at a pressure in the range of from about 0 to about 5 bar.

4. A process according to claim 1 wherein said mixture of gaseous ammonia and solvent vapors at a temperature in the range of 120° to 180° C. is cooled at a pressure in the range of 0 to 5 bar to a temperature in the range of 50° to 95° C. by direct contact with liquid N-methyl-2-pyrrolidone at a temperature in the range of 40° to 70° C. whereby said solvent vapors are substantially completely separated from said gaseous ammonia.

* * * * *